United States Patent [19]

Silvestri et al.

[11] Patent Number: 4,828,667

[45] Date of Patent: May 9, 1989

[54] ELECTROLYTIC CELLS WITH CONTINUOUSLY RENEWABLE SACRIFICIAL ELECTRODES

[76] Inventors: Giuseppe Silvestri, via Tasso 21; Giuseppe Filardo, via delle Magnolie 10; Salvatore Gambino, via C. Camilliani 39, all of Palermo, Italy

[21] Appl. No.: 164,859

[22] Filed: Mar. 7, 1988

[30] Foreign Application Priority Data

Mar. 18, 1987 [IT] Italy ..... 19740 A/87

[51] Int. Cl.[4] ..... C25B 9/00; C25B 11/03; C25B 13/00

[52] U.S. Cl. ..... 204/255; 204/257; 204/268; 204/269; 204/283; 204/284

[58] Field of Search ..... 204/255, 257, 268, 269, 204/275, 283, 284, 151

[56] References Cited

U.S. PATENT DOCUMENTS

| | | | |
|---|---|---|---|
| Re. 32,077 | 4/1986 | De Nora et al. | 204/283 X |
| 2,952,604 | 9/1960 | Denora | 204/257 X |
| 3,663,298 | 5/1982 | Mc Coy et al. | 204/284 |
| 4,589,968 | 5/1986 | Toomey, Jr. | 204/257 |
| 4,692,229 | 9/1987 | Bjäreklindt et al. | 204/151 |

*Primary Examiner*—Donald R. Valentine

*Attorney, Agent, or Firm*—Parkhurst, Oliff & Berridge

[57] ABSTRACT

A filter press type electrolytic cell for continuous operation with renewable sacrificial electrodes. Said device enables cells of the filter press type to be fitted with a sacrificial electrode formed from metallic particles or generally from particles which are consumed during the electrolysis, and which can be continuously renewed.

The modified cells according to the invention can be used successfully for electro-organic processes.

12 Claims, 1 Drawing Sheet

ELECTROLYTIC CELLS WITH CONTINUOUSLY RENEWABLE SACRIFICIAL ELECTRODES

TECHNICAL FIELD

This invention relates to a device for converting electrolytic cells of filter press type into cells with continuously renewable sacrificial electrodes.

More specifically, the invention relates to a device which enables a sacrificial electrode to be inserted into cells of the filter press type, the electrode being formed of metal particles or particles which in any event are consumed during electrolysis and which can be renewed continuously. The modified cells according to the invention can be successfully used for electroorganic processes.

BACKGROUND OF THE INVENTION

Thus in a simple and economical manner a continuously operating electrolytic cell for electro-organic processes is obtained which would otherwise have to be prepared for this purpose and would have a very high cost.

Electrochemical processes using sacrificial electrodes have been long known, and some of them are of applicational interest.

Examples in which the cathode or anode material is consumed during the course of the electrolysis include the production of element-organic compounds such as some alkyl selenides or organometallic compounds such as lead alkyls or Ziegler-Natta catalysts, or the synthesis of coordination compounds such as acetylacetonates, squarates or carboxylates.

However the technology of sacrificial electrode cells is not sufficiently advanced to enable them to be used for electro-organic processes. Of the many models described, only that proposed by Messrs. Nalco (U.S.A.) (P. Gallone, Trattato di ingegneria elettrochimica. publ. Tamburini 1973, pp 595–599) has found large-scale application, and is associated ideally with a heat exchanger comprising a tube bundle in which the steel tubes constitute the cathode and contain in their interior, separated by a mesh of inert material, the lead which is consumed by the anodic reaction. A cooling medium circulates on the outside of the tubes. Without examining in detail the other models described in the literature, and which in any case have not found large-scale application, the construction of a cell with sacrificial electrodes presents problems which have not yet been satisfactorily solved.

As the sacrificial electrode material passes into solution during the electrolysis, if the electrode is in the form of a single metal bar there is a progressive retraction of the metal surface, with an increase in the distance between electrodes and a consequent increase in the cell resistance. This drawback could be overcome by using cells of the Lockheed type (J. F. Cooper, Electric and Hybrid Vehicle System Assessment Seminar, Gainesville, Florida, Dec. 1983) in which the anode metal is consumed against a suitably shaped cathode on which the metal anode bar rests by being held by suitable spacers such that the distance between electrodes remains constant. Other models could be obtained from inorganic electrochemistry, such as the electrolytic refining of metals in which the anode metal, generally in the form of scrap, is fed into a basket and is consumed at a distance between electrodes dictated by the geometry of the basket itself, but the transfer of this type of technology to organic electrochemistry appears problematic.

Obviously in those cases in which the distance between electrodes increases, electrolysis is periodically interrupted in order to open the cell and replace the consumed anodes.

With regard to electro-organic processes, the model which continues to be used is in most cases of the filter press type for which a considerable amount of experience has been obtained and which is commercially available in various versions, so as to satisfy fairly diverse operational requirements. There is therefore an immediate applicational interest in devices which would allow already existing cells of the filter press type and their accompanying technology to be conveniently used for such processes without the complicated equipment required for operating the cells (pumps, tanks, pipes, heat exchangers etc.) having to be substantially modified.

The device described in this patent enables any cell of conventional filter press type to be used by converting it into a continuously operating cell with renewable sacrificial electrodes.

SUMMARY OF THE INVENTION

The sacrificial electrode is of the "particulate" type, ie consisting of granules or fragments of metal or generally of the material to be consumed during electrolysis. These granules can be added to the cell continuously by suitable feed systems, or periodically by opening a suitable closure system located at the top of the device without this requiring complete or even partial dismantling of the cell.

The device for converting electrolytic cells of filter press type into continuously operating cells with renewable sacrificial electrodes according to the present invention is a container characterised by being in the shape of a plate having in its upper part a duct for feeding the constituent particulate material of the sacrificial electrode to a hollow sector which is without walls on those two of its side faces which are intended to face the cell cathodes, lateral closure being obtained by those members normally present in cells of the filter press type which separate the anode region from the cathode region.

These and further characteristics and advantages of the device according to the invention will be more apparent from the detailed description given hereinafter of preferred embodiments thereof given by way of non-limiting illustration.

BRIEF DESCRIPTION OF THE DRAWINGS

With reference to the accompanying figures and the respective reference numerals or letters thereon.

DETAILED DESCRIPTION OF THE INVENTION

Figures 1, 1A:
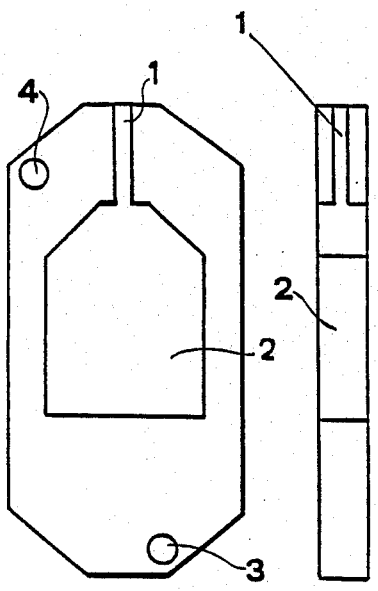
FIGS. 1 and 2 are sections through two embodiments of the device according to the invention.
FIGS. 1A and 2A are side sectional views of the embodiments shown in FIGS. 1 and 2, respectively
Figures 2, 2A:
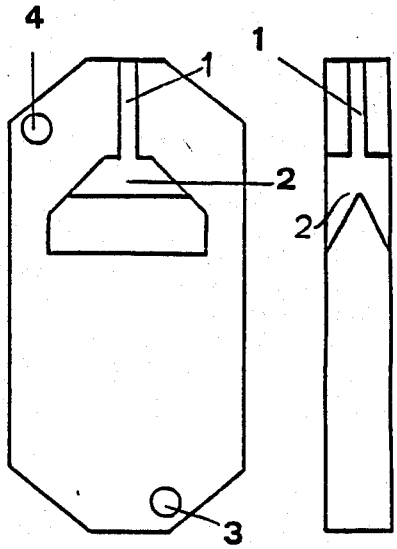

In FIGS. 1 and 2 the reference numeral 1 represents the duct for feeding the constituent particulate material of the sacrificial electrode. This duct can be closed by a screwed plug or other means, which is removed periodically for feeding the particulate material. Alternatively, said duct can be connected upperly to means which allow the particulate material to be continuously fed. The reference numeral 2 represents the hollow sector which is without walls on the two faces of larger area. The reference numerals 3 and 4 represent the electrolytic solution inlet and outlet holes respectively.

In the application according to the invention, the device of FIG. 1 faces the cathode and is separated therefrom by a dividing mesh adjacent to the device with the result that the particulate anode is retained in the hollow sector 2.

Figure 3:
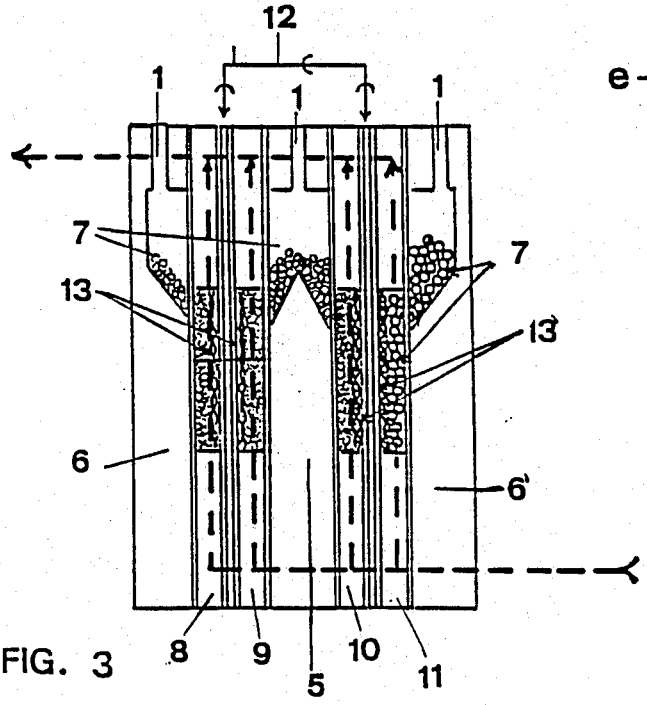
FIG. 3 shows the application of elements according to the invention to an electrolytic cell of the filter press type.

In contrast, the device of FIG. 2 faces the cathode by way of an interposed chamber communicating with the hollow sector 2 and thus the device operates as a distributor for distributing the particulate material to said chamber as shown in FIG. 3.

A device 5 formed in accordance with FIG. 2 is fitted in a central position in the electrolytic cell of FIG. 3, and in addition two devices 6 and 6' of modified structure compared with FIG. 2 are fitted in peripheral positions. The device 5 has a structure which enables the particulate anode material 7 to be distributed simultaneously into the two two chambers 9 and 10, whereas each device 6 and 6' distributes said material into only one chamber, namely the chamber 8 and the chamber 11 respectively.

Spacer elements are disposed in each of said chambers to define the anode space.

The anode material is separated from the cathodes 12 by the grids 13 and 13' which are constructed of PTFE-covered glass fibres 1.5 mm thick, and have a mesh aperture width of 2 mm.

The electrolyte solution flow indicated by the dashed lines and respective arrows takes place from the bottom upwards.

The electrolytic cell is assembled using suitably shaped 2 mm thick EPR rubber sheets as gaskets.

The particulate anode material is commonly a metal in the form of granules or small cylinders.

The device according to the invention can consist of the most diverse non-metallic, metallic conductor or polymer materials. If metallic materials are used, the anodic dissolution voltage of the constituent metal of the container member must be more positive or at least equal to that of the material used as the sacrificial anode. If polymer materials are used, a band of electrically conducting material must be suitably disposed along the inner surface of the device and then connected to the outside to ensure current feed to the particulate elements amassed in the container.

For example the device can be constructed of carbon steel which after the machining work is complete can be chromium plated.

As stated, the device according to the invention is conveniently applied to already existing cells of the filter press type, and for example can be applied successfully to the model MP cell of the Swedish company Elektrocell AB.

The described cell can obviously be formed with a larger number of elements. Moreover with the devices of the invention disposed facing each other it is possible to form dipolar systems in which the electrolytic solution passes through a series of particulate electrodes contained in a like number of devices according to the invention. The electrical connection is made only with the initial and terminal electrode, so saving current-carrying bars.

In this embodiment the sacrificial electrodes operate on one side as anode and on the other side as cathode.

Figure 4:
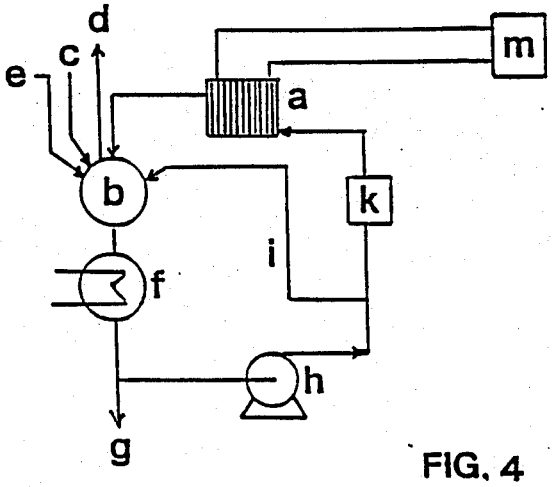
FIG. 4 shows the equipment used for the electrocarboxylation of 2-acetonaphthone of Example 1 described hereinafter.

The arrangement of FIG. 4 represents one practical embodiment of the invention. In this arrangement a model MP electrolytic cell (a) of the Swedish company Elektrocell AB is used, to which the devices of the invention are applied as shown in FIG. 3.

In this arrangement, (b) represents a $CO_2$ saturator tank, (c) the $CO_2$ feed line, (d) the gas discharge line, (e) the electrolyte solution make-up line, (f) a heat exchanger, (g) the electrolyte solution discharge, (i) a bypass, (k) a flowmeter and (m) the direct current supply source.

By using said arrangement, the following example involving the electrocarboxylation of 2-acetonaphthone was implemented, and is described by way of non-limiting example.

EXAMPLE 1

Using the arrangement shown in FIG. 4 and incorporating the electrolytic cell of FIG. 3, 2-acetonaphthone was subjected to electrocarboxylation for the production of α-hydroxy-α-naphthylpropionic acid by the following reactions:

(at the cathode) $C_{10}H_7{-}CO{-}CH_3 + 2e^- + CO_2 \longrightarrow$

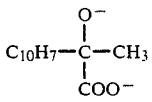

(at the anode) $Al \longrightarrow Al^{3+} + 3e^-$

The electrode characteristics are:

Cathode: Zn plate 1 mm thick; cathode surface area 400 $cm^2$;

Anode: 99.5% Al cylinders 4 mm diameter × 15 mm length; apparent anode surface area 500 $cm^2$.

The electrolysis is conducted using N,N-dimethylformamide (2 l) as solvent and tetrabutylammonium bromide (32 g/l) as support electrolyte.

The operating conditions are:

Total current intensity: 7–9 A
Temperature: 20° C.
Flow rate: 15–22 l/min
Total applied voltage: 7–9 V
2-acetonaphthone concentration: 100 g/l
Circulated charge: 240,000 Coulombs
Anode material consumption: 24.5 g
Anodic process current yield: 110%
Yield of hydroxyacid aluminium salt: 75%
Cathodic process current yield: 75%.

On opening the cell a uniform aluminium consumption is observed, causing the cylinders contained in the upper part of the device to descend into the electrolysis region. The walls of the device show no apparent signs of corrosion.

As can be seen from the reported data, this sacrificial anode system is reliable at the synthesis level and allows organic and organometallic synthesis processes to be conducted.

We claim:

1. A filter press type electrolytic cell for continuous operation with renewable sacrificial electrodes comprising a plate-shaped element having in its upper part a duct for feeding constituent particulate sacrificial electrode material to a hollow sector which is without walls on two side faces which are intended to face the cell cathodes, and means for holding said electrolytic cell and said cathode together.

2. An electrolytic cell as claimed in claim 1, wherein said duct is closed by a screwed plug or other means which may be removed to feed the particulate material.

3. An electrolytic cell as claimed in claim 1, wherein said duct is connected to means for continuously feeding particulate material.

4. An electrolytic cell as claimed in claim 1, wherein the particulate is retained in the hollow sector by a dividing mesh which is adjacent to said plate-shaped element and which separates said plate-shaped element from the cathode.

5. An electrolytic cell as claimed in claim 1, further comprising an interposed chamber communicating with the hollow sector, said electrolytic cell including distributor means for distributing particulate material to said chamber.

6. An electrolytic cell as claimed in claim 1, further comprising first and second chambers into which the particulate material may be distributed simultaneously.

7. An electrolytic cell as claimed in claim 1, further comprising a chamber into which the particulate material may be distributed.

8. An electrolytic cell as claimed in claim 1, wherein said plate-shaped element is constructed of electrically conducting material having an anodic dissolution voltage which is more positive than or at least equal to that of the particulate material.

9. An electrolytic cell as claimed in claim 1, wherein said plate-shaped element is constructed of polymer material provided with a band of electrically conducting material disposed along its inner surface and provided with an electrical connection to the outside of said cell.

10. An electrolytic cell as claimed in claim 1, said cell being arranged for the implementation of electro-organic processes.

11. Dipolar systems characterised in that the electrolytic solution passes through a series of particulate electrodes contained within a like number of plate-like elements as claimed in claim 1, the electrical connection being made only with the initial electrode and with the final electrode.

12. An electrolytic cell as claimed in claim 1, wherein said means for holding said electrolytic cell and said cathode together comprise members normally present in cells of the filter press type which separate the anode region from the cathode region.

* * * * *